US005200153A

United States Patent [19]

Carr et al.

[11] Patent Number: 5,200,153

[45] Date of Patent: Apr. 6, 1993

[54] CONTAINER WITH CAP ATTACHED BY A DOUBLE HINGE

[75] Inventors: Anthony H. Carr, Bedfordshire; Paul R. Darnell, Northamptonshire; Ian W. Davidson, Bedfordshire, all of England

[73] Assignee: Unilever Patent Holdings, B.V., Great Britain

[21] Appl. No.: 623,972

[22] PCT Filed: Apr. 12, 1990

[86] PCT No.: PCT/GB90/00569

§ 371 Date: Dec. 13, 1990

§ 102(e) Date: Dec. 13, 1990

[87] PCT Pub. No.: WO90/12648

PCT Pub. Date: Nov. 1, 1990

[30] Foreign Application Priority Data

Apr. 14, 1989 [GB] United Kingdom ..... 8908547

[51] Int. Cl.[5] ..... B01L 3/00

[52] U.S. Cl. ..... 422/102; 73/864.11; 215/306; 220/339; 220/375; 220/732; 222/570

[58] Field of Search ..... 220/307, 339, 367, 375, 220/669, 732; 422/102; 206/527; 222/566, 567, 570; 215/237, 306, 100 R; 73/864.11, 864.62

[56] References Cited

U.S. PATENT DOCUMENTS

| | | | |
|---|---|---|---|
| 4,215,700 | 8/1980 | Crouther et al. | 128/763 |
| 4,625,899 | 12/1986 | Stull | 220/367 |
| 4,713,219 | 12/1987 | Gerken et al. | 422/102 |

*Primary Examiner*—James C. Housel
*Assistant Examiner*—Maureen M. Wallenhorst
*Attorney, Agent, or Firm*—Cushman, Darby & Cushman

[57] ABSTRACT

A container or vessel useful in the preparation of bacterial extracts or similar analytical samples, constructed of resilient flexible plastics material and having a releasably engageable cap (3) incorporating a nozzle (8) through which liquid contents of the container may be expressed by squeezing the container, the cap being linked to the container by a double hinge comprising two strips (14*a*, 14*b*) of material which fold back upon themselves when the container is closed by the cap, the apices (18*a*, 18*b*) of the folded hinge strips together providing contact points upon which the capped end of the container may be rested on a horizontal surface such as a work bench.

6 Claims, 3 Drawing Sheets

CONTAINER WITH CAP ATTACHED BY A DOUBLE HINGE

This invention relates to containers having an outlet for the expulsion of fluid, for use for example in the preparation of assay samples.

Inexpensive disposable containers are known which typically comprise a tubular vessel of plastics material having a flexible wall, and a cap for sealing the tubular vessel. The cap releasably engages the tubular vessel, and has an outlet through which fluid may be dispensed. The fluid may be expelled under positive pressure by squeezing the flexible wall of the tubular vessel. These containers may also have a filter positioned in the cap to filter particulate or amorphous material as the fluid is expelled.

However, the cap, once removed by a technician using such a container, is easily mislaid. This may lead to contamination of the contents of the container. Also, when the container contains fluid, to prevent the contents spilling it is necessary that the container is stored in such a way as to prevent it being knocked over or to prevent the fluid in any way escaping from the container, for example by storing it in a rack.

The invention provides a vessel closable by a releasably engageable cap having a nozzle through which liquid contents in the vessel may be expelled, wherein the cap is attached to the vessel by hinge means and wherein the hinge means provides means for supporting the vessel when the vessel is capped.

Preferably, the hinge means provides for supporting the capped end of the vessel when the vessel is resting on a surface, and more particularly for supporting the capped end of the vessel at an elevation above that of the surface.

Preferably the vessel including the cap and hinge means is constructed integrally of resiliently flexible moisture-impervious material, such as plastics material. Preferably, the material is temperature-resistant so that the vessel may be used during the preparation of an assay sample involving extraction at elevated temperature.

In a particularly preferred embodiment of the invention, the hinge means comprises a pair of strips of material, each pair member being attached to both the vessel body and the cap at positions diametrically opposed to the positions at which the other pair member is attached thereto. Ideally, during closure of the vessel the hinge means folds back upon itself and projects laterally from the vessel, the apex or apices of the fold providing one or more potential points of contact with a surface, such as a laboratory bench top, upon which the capped vessel may be placed.

By providing a container comprising a vessel and a cap attached to the vessel by hinge means, the invention has the advantage that there is no need for the cap to be held by the operator or put down whilst filling the vessel, thereby minimising the risk of either losing the cap or contaminating the sample. The hinge also acts as a stand or support for the container when closed. This can be achieved, for example, if the hinge means is sufficiently long such that when the cap is engaged by the vessel, the hinge means folds back on itself and projects from the vessel.

The folded hinge means provides at least one contact point remote from the container by which the capped end of the container may rest above a horizontal surface. As a result, the closed container will not roll about on the horizontal surface. The necessity of placing the container in a rack when fluid contents are present in the vessel is therefore removed.

An embodiment of the invention will now be described, by way of example only, with reference to the accompanying drawings, of which:

Figure 1:
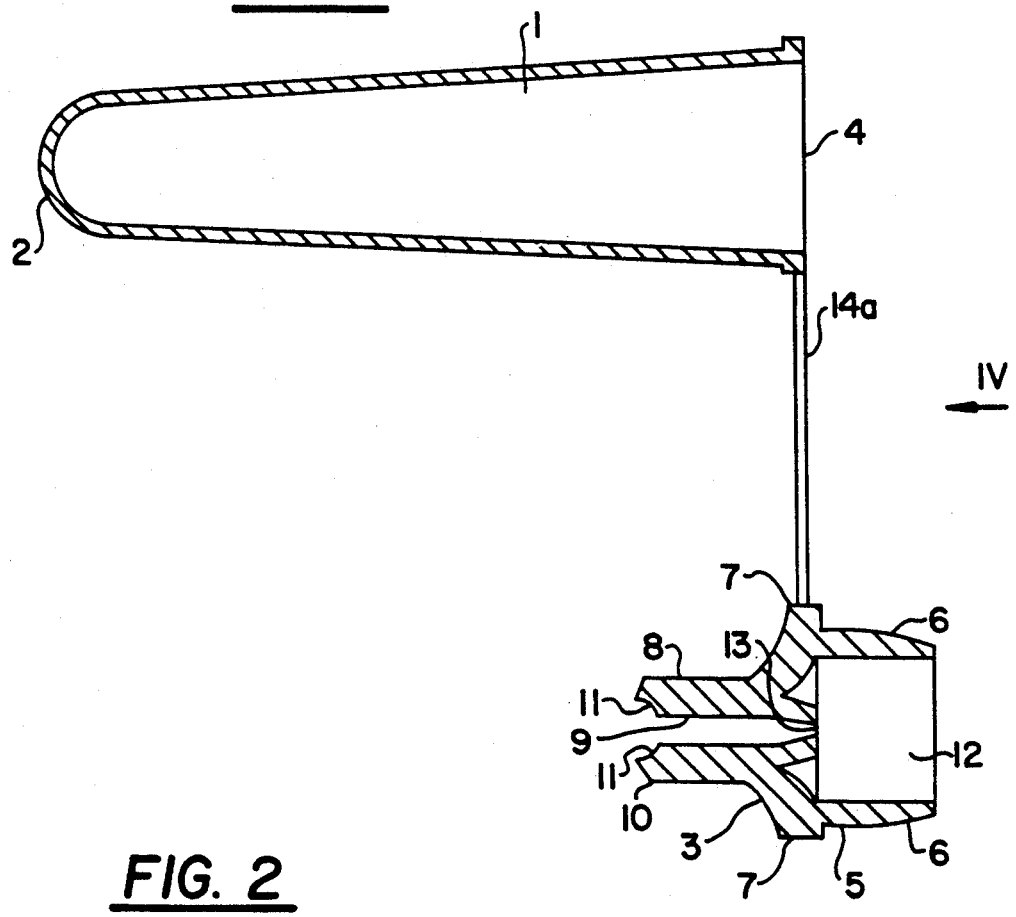
FIG. 1 shows a longtudinal cross section of a container according to the invention.

The container of FIG. 1 comprises a substantially tubular body 1 of circular cross section having a closed rounded end 2. Tubular body 1 tapers towards the closed end 2. Cap 3 can frictionally engage and close open end 4 of tubular body I by way of a tubular portion 5, forming a substantially liquid-tight seal. Portion 6 of the tubular portion 5 is tapered. Cap 3 has a projecting rim 7 which limits how far cap 3 can be pushed into tubular body 1. Protruding forward from cap 3 is nozzle 8, axially disposed about cap 3. Bore 9 of the nozzle 8 is substantially parallel along most of its length, but adjacent to the dispensing end 10 of the cap 3 widens to form a lip 11. Where nozzle 8 meets the space 12 within tubular portion 5, bore 9 tapers to provide a hole 13 for access to space 12 of narrower diameter than bore 9. The internal profile of cap 3 facilitates discharge of fluid from the container controllably in droplets of consistent size. Cap 3 is hinged to tubular body 1 by two hinge strips 14*a*, 14*b* of material (only one of which, 14*a*, is visible in FIG. 1).

Figure 2:
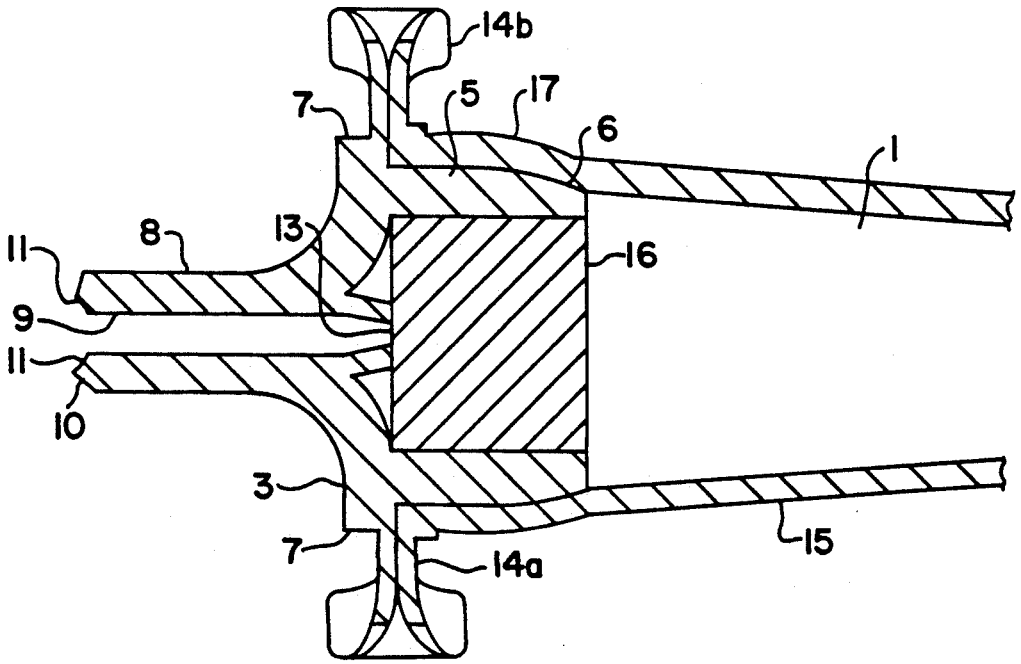
FIG. 2 shows in section part of the container shown in FIG. 1 when in the closed state.

Referring to FIG. 2, cap 3 is shown in the closed position within vessel 1. The frictional engagement of cap 3 within tubular body 1 is provided by the elastic and/or plastic deformation of wall 15 of tubular body 1.

The container of FIG. 2 additionally has a filter 16, made for example of "Porex", occupying space 12. (FIG. 1) Hinges 14*a*, 14*b* are shown attached at one end to rim 7 of cap 3, and at the other end to the portion 17 of the wall 15 of tubular body 1 surrounding the open end 4. Hinge 14*b* is attached to rim 7 and portion 17 at a diametrically opposite position to the attachment of hinge 14*a* to rim 7 and portion 17. Hinges 14*a*, 14*b* are strips of flexible material of equal length which act as hinges for cap 3 when it is not releasably engaged to vessel 1, and can also act as "legs" to support the capped end of vessel 1 when it is closed by cap 3 and placed on a solid surface.

Figure 3:
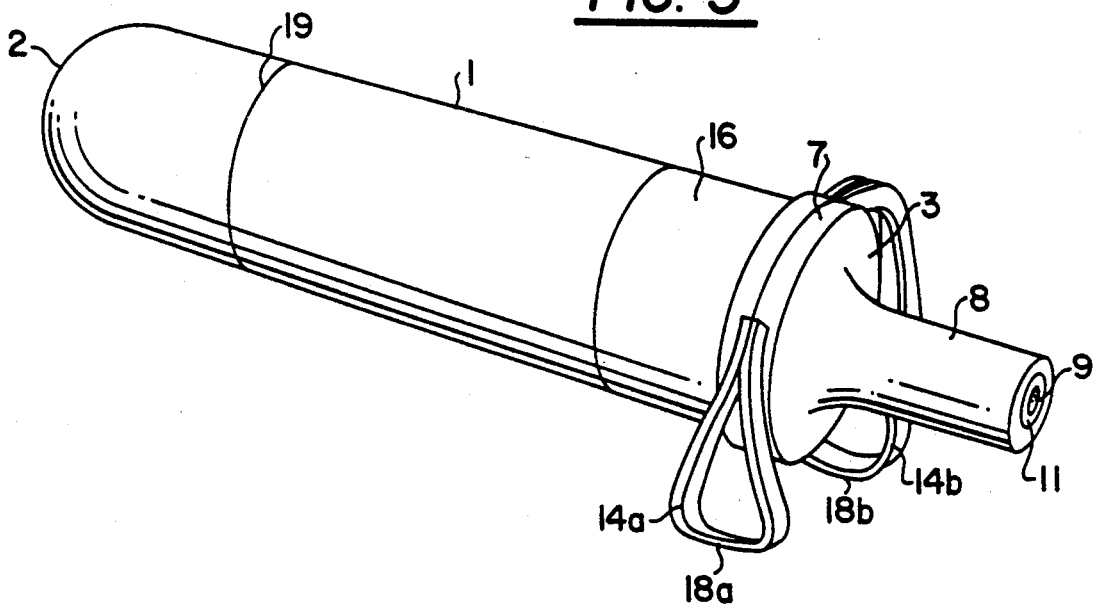
FIG. 3 shows a profile of the container of FIG. 2 when closed.

This is more clearly seen in FIG. 3. Tubular body 1 rests on its closed end 2, and on the apices 18*a*, 18*b* of folded hinges 14*a*, 14*b*. The tubular body 1 of FIG. 3 may be manufactured from translucent materials, and additionally has a graduated volume line 19 visible which indicates a known volume within tubular body 1.

Figure 4:
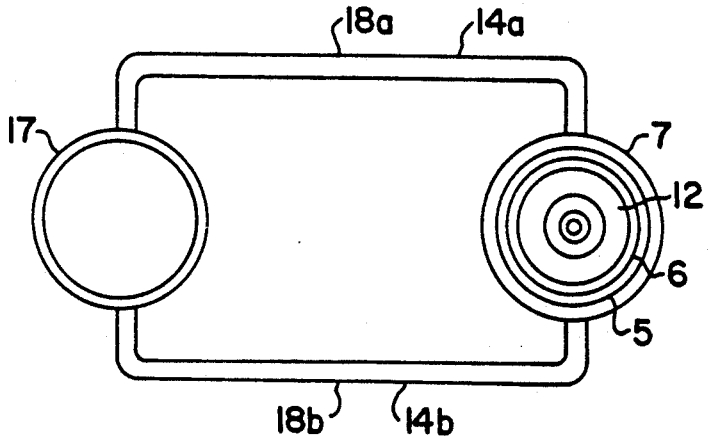
FIG. 4 shows an elevation from the direction IV shown in FIG. 1.

FIG. 4 shows an end elevation of the container of FIG. 1. This clearly shows the position of attachment of hinges 14*a*, 14*b* to rim 7 and portion 17. Both hinges 14*a*, 14*b* are "U" shaped.

The end of the tubular body 1 need not be rounded, but may be any convenient shape. The walls 15 of the tubular body need not be converging, but may be any convenient shape, such as parallel. The cross-section of tubular body 1 need not be circular, but may be any convenient shape.

The container can be manufactured from plastics materials, for example polyethylene. A preferable plastics material is a low density polythene, for example LUPOLEN 1800H. The plastics material should contain sufficient plasticizer such that wall 15 of the tubular body 1 does not crack after repeated pressurisation to dispense fluid. Preferably the container surfaces are polished.

Conveniently, the tube is manufactured from a plastics material which has a degree of temperature resistance, and does not deform when subjected to heating. For example, containers according to the invention may be used in extraction procedures which require the presence of heat (for example, 80° C. for 10 minutes), so it is most desirable that the plastics material used to form the container does not decompose or deform when subjected to the degree of heating necessary to conduct the reaction. Examples of such uses are the preparation of bacterial extracts, e.g. from infectious disease organisms such as Chlamydia and Neisseria, prior to analytical testing for the presence of such organisms in clinical samples.

Figure 5:
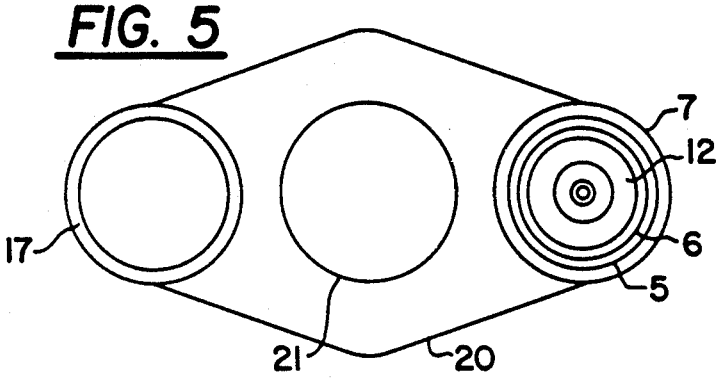
FIG. 5 shows an end elevation of an alternative embodiment of the invention in the open state.

FIG. 5 shows an end elevation of a container comprising the same tubular body 1 and cap 3 as described in FIG. 1 above, but employing an alternative hinge means 20. The hinge means 20 comprises a single piece of flexible material attaching rim 7 to portion 17. To save material the hinge means 20 has circular portion 21 removed. This hinge means 20 also functions according to the invention.

Figure 6:
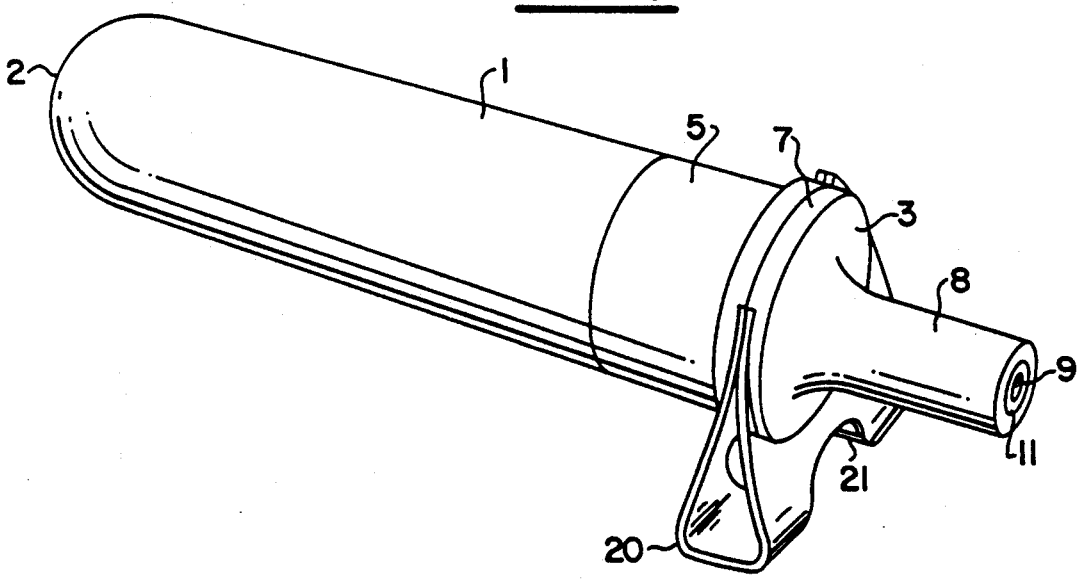
FIG. 6 shows a profile of the container of FIG. 5 in the closed state.

FIG. 6 shows the container of FIG. 5 in profile.

EXAMPLE

A typical vessel according to the invention, essentially as described above with reference to FIGS. 1 to 4, can have the following dimensions.

A tapered round bottomed tube of length 50 mm having a circular cross section, and an internal diameter at its open end of 9.4 mm. The vessel is injection-moulded from translucent plastics material, and the wall thickness of the vessel is 0.8 mm. The cap has a nozzle of length 8.5 mm, with a bore of 1.5 mm. The cap is moulded such that the access hole from the area of the cap surrounded by the vessel engaging flange is 0.3 mm diameter, but tapers out to a bore of 1.5 mm over a distance of 3 mm within the cap. The hinging strips are 2.5 mm wide, and each links diametrically opposite points on the periphery of each of the cap and the vessel. When opened out fully (as in FIG. 4) to the extreme of the hinges, the distance between the central axes of the vessel and the cap is 20 mm. The surfaces of the vessel are polished to ISOR1302.

We claim:

1. A container comprising:

a tubular main body having an opening defined therein;

a cap for closing said opening; and hinge means for attaching said cap to said tubular main body, said hinge means consisting essentially of first and second strips of material, each of said strips of material being attached to both said tubular main body and to said cap, said first strip of material being attached to said cap and to said tubular main body at positions diametrically opposed to positions at which said second strip of material is attached to said tubular main body and to said cap, respectively, said hinge means together defining support means when said cap closes said opening, said support means supporting a portion of said tubular main body so that said closed opening is at an elevation above a surface on which said tubular main body is horizontally disposed.

2. A container according to claim 1, wherein said tubular main body, said cap and said hinge means are constructed integrally of resiliently flexible moisture-impervious material.

3. A container according to claim 2, wherein said material is plastic.

4. A container according to claim 2, wherein said material is temperature-resistant.

5. A container according to claim 1 wherein said hinge means folds back upon itself and projects laterally from said tubular main body during the closure of the opening in said tubular main body by said cap.

6. A container according to claim 1, wherein said cap incorporates a filter through which a liquid must pass to be expressed from said main body.

* * * * *